United States Patent [19]

Schellenberg

[11] Patent Number: 4,742,935

[45] Date of Patent: May 10, 1988

[54] PACKAGING CONTAINER

[75] Inventor: Walter Schellenberg, Diepoldsau, Switzerland

[73] Assignee: Sandherr Packungen AG, Diepoldsau, Switzerland

[21] Appl. No.: 72,460

[22] Filed: Jul. 13, 1987

[30] Foreign Application Priority Data

Jul. 14, 1986 [CH] Switzerland ..... 02810/86

[51] Int. Cl.[4] ..... B65D 39/00

[52] U.S. Cl. ..... 220/307; 220/270

[58] Field of Search ..... 220/307, 270, 339

[56] References Cited

U.S. PATENT DOCUMENTS 4,300,700 11/1981 Chang ..... 220/307

4,474,305 10/1984 Marco ..... 220/307

4,592,480 6/1986 Hart et al. ..... 220/307

*Primary Examiner*—George T. Hall

*Attorney, Agent, or Firm*—Ladas & Parry

[57] ABSTRACT

The flange-like lid rim of a packaging container, including the outwardly projecting gripping part shaped thereon, is laterally enclosed by an all-round rim portion, so that it is not accessible for opening the packaging container. The actuation of the gripping part leads to the separation of a rim extension of the container body engaging below the gripping part and to which the latter is non-detachably connected by a pushbutton connection. The sealing fixing of the lid to the container body takes place by interlocking engagement beads. The packaging container avoids any hot sealing joint as a guarantee seal and is made from completely burnable plastic.

10 Claims, 3 Drawing Sheets

PACKAGING CONTAINER

BACKGROUND OF THE INVENTION

The present invention relates to a packaging container with a container body and a lid connected by locking fastening means to the opening rim and whereby onto one part of the lid rim is shaped an outwardly projecting gripping part.

Packaging containers of this type are commercially available in numerous different forms, but it is a disadvantage thereof that it is not possible to see whether they have been already opened. Thus, packaging containers made from plastic are known, in which the lid is fixed by hot sealing wax to the container body, the hot sealing joint forming a predetermined separating region on opening. However, the use of such a hot sealing joint requires the manufacture of the container from a relatively thermally stable plastic material, i.e. PVC, which constitutes a considerable, undesired burden on garbage incinerating plants. In addition, following the opening of the container, the hot sealing joint leaves behind a unclean opening rim. It is also difficult to provide on a hot sealing joint a clearly defined leak or pervious point for venting the container, such as is required for certain products to be packaged, e.g. cottage cheese.

SUMMARY OF THE INVENTION

The problem of the present invention is to provide a packaging container of the aforementioned type, which makes it necessary to destroy a predetermined separating point on opening and which also can be manufactured in simple manner from a plastic material which can be burned without leaving any residue. It must also be possible to simply provide a venting point on the opening rim.

In order to solve this problem, a packaging container of the aforementioned type is inventively constructed in such a way that the lid rim is laterally embraced by a container body rim portion and that the gripping part of the lid is non-detachably fixed to a rim extension of the container body connected to the latter via a predetermined breaking point.

The non-detachable connection between the gripping part and the rim extension can be constructed similar to a rivet joint or in pushbutton-like manner, so that it is the predetermined breaking point and not said connection which is destroyed on opening.

In order to provide a good seal along a locking opening rim, the lid is preferably made from a harder plastic material, e.g. polystyrene, on which sealingly engages a softer plastic material, e.g. polypropylene of the container body.

For the space-saving transportation of the container body and the lid to the filling point, at least the container body is preferably constructed in such a way, e.g. conically that the containers can be stacked in one another.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
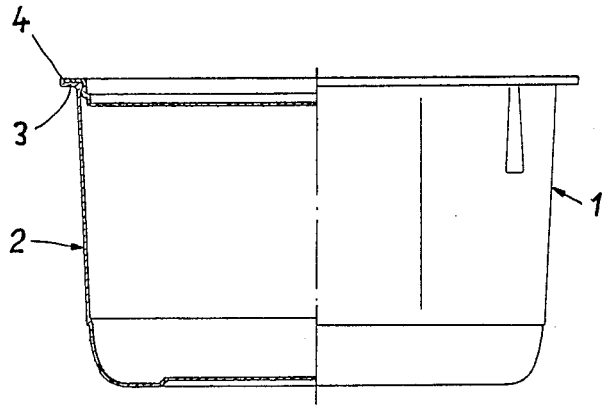
FIG. 1 A half-sectional side view of a packaging container.
Figure 2:
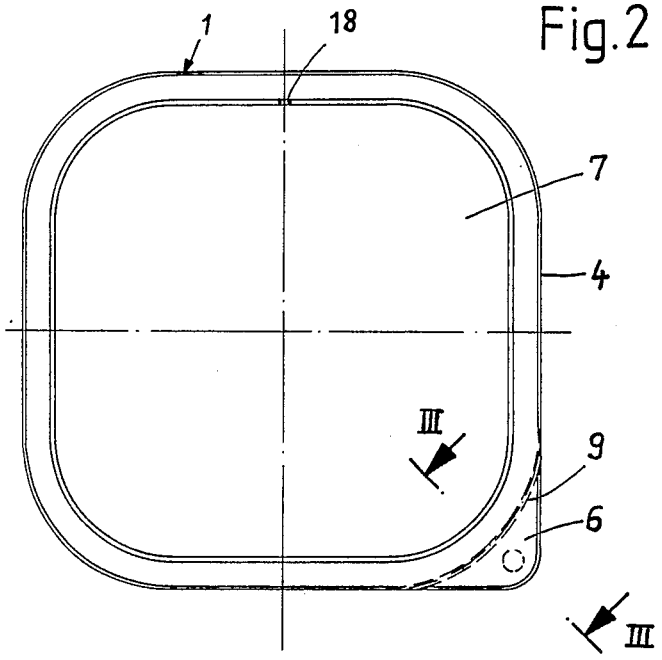
FIG. 2 A plan view of the packaging container according to FIG. 1.
Figure 3:
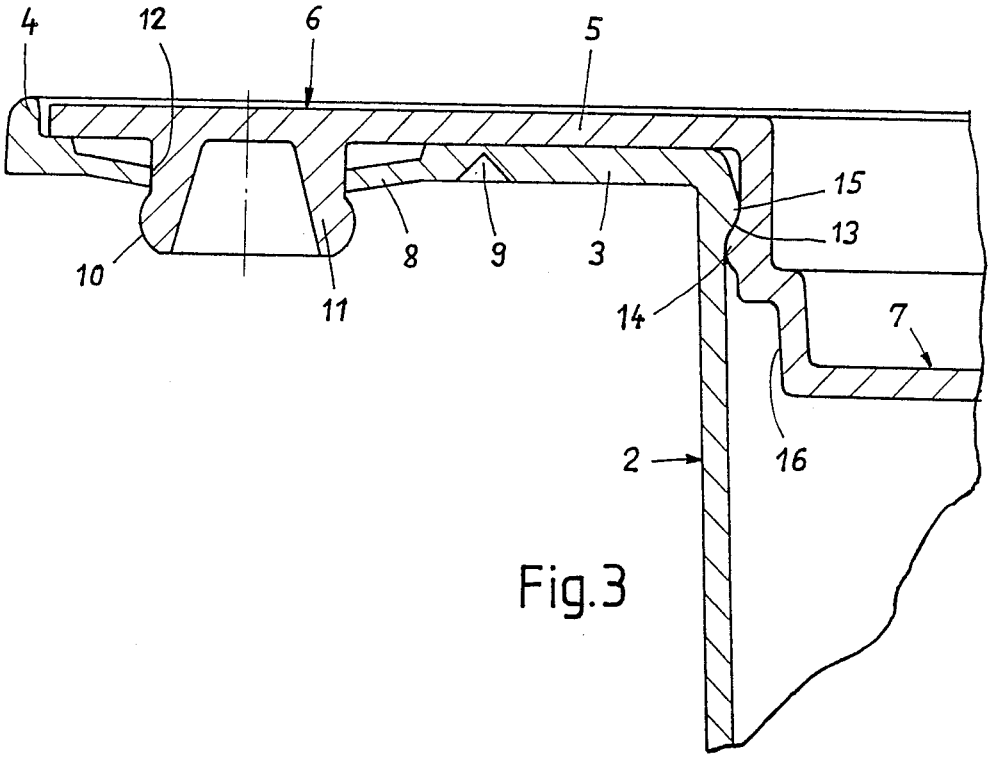
FIG. 3 A larger-scale cross-sectional representation in the vicinity of the gripping part, corresponding to a section along line III—III of FIG. 2.
Figure 4:
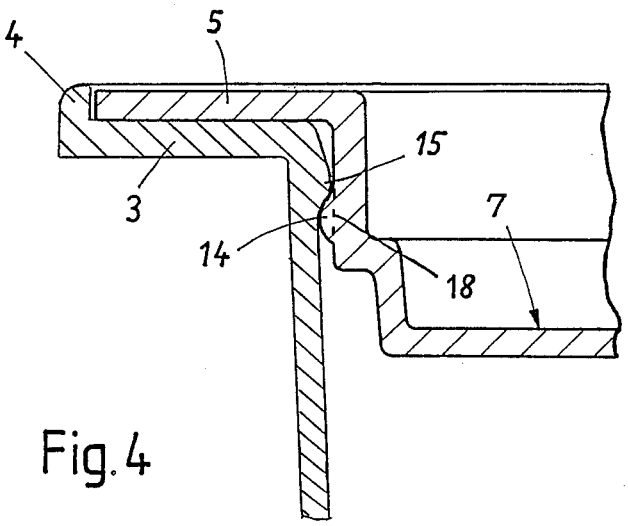
FIG. 4 A larger-scale cross-sectional representation in a rim region of the packaging container.
Figure 5:
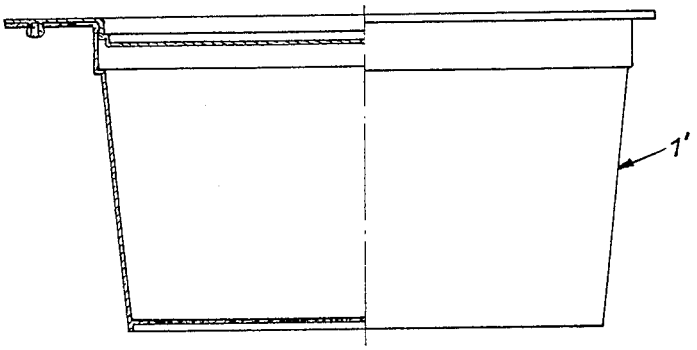
FIG. 5 A half-sectional side view of another embodiment of an inventive packaging container.
Figure 6:
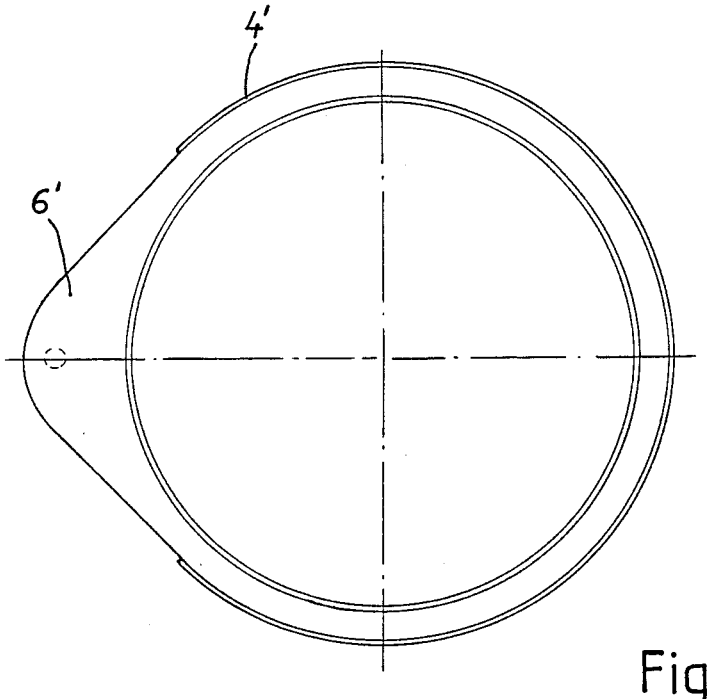
FIG. 6 A plan view of the packaging container according to FIG. 5.

The represented packaging container 1 is e.g. intended for cottage cheese and in plan view has an approximately square shape with rounded corner regions, so that identical containers can be housed in juxtaposed, superimposed space-saving manner in a larger transportation container with standardized dimensions. For the purpose of stacking with other containers, prior to filling, the container body 2 has slightly upwardly diverging side walls. Its opening rim has an outwardly projecting, all-round flange 3, whose outer rim portion is directed away from the container rim at right angles in the upwards direction, so as to laterally embrace the lid rim 5 also shaped in flange-like manner, as can best be seen from FIG. 4. Thus, the lid rim 5 is protected against easy access and opening of the packaging container. According to the embodiment of FIGS. 1 to 4, said outer rim portion can also surround a gripping part 6 of lid 7 provided on one of the corner regions of the packaging container 1 and which extends away from the flange 3 of container body 2. For this purpose, at the corresponding circumferential point, the flange 3 is widened to a rim extension 8, which engages below gripping part 6. However, FIGS. 5 and 6 show an embodiment of the invention, in which the outer rim portion 4' ends at a distance from gripping part 6'. FIG. 6 also shows that an inventive packaging container can have different cross-sectional forms.

Between the rim extension 8 and container flange 3 is provided a predetermined breaking line 9, which is e.g. formed by a cross-sectionally V-shaped groove. An actuation of gripping part 6 of lid 7 for opening packaging container 1 necessarily leads to breaking along the predetermined separating line 9 due to the fixed connection between the rim extension 8 and gripping part 6, so that container 1 is provided with a guarantee seal.

In the represented embodiment, the fixed connection between gripping part 6 and rim extension 8 comprises a non-detachable pushbutton connection, in that a hollow pin 11 having a bead 10 shaped onto the underside of gripping part 6 is pressed through a hole 12 in the rim extension. This connection or joint can be produced particularly simply if lid 7 with its gripping part 6 and said hollow pin 11 are made from a harder plastic material than the container body 2 and the rim extension 8 shaped onto it, or if the latter is made from a relatively soft plastic material, such as e.g. polypropylene.

This material combination is also advantageous for a tight connection on the all-round engagement rim 13 between the interlocking engagement beads 14, 15 of lid 4 and the inner opening rim.

In the lower part, lid 7 has an inwardly offset portion 16, which engages in the upper part of the particular lid 7 when stacking the container lids.

A short, groove-like bead interruption 18 is provided at one point on the engagement beads 14, 15 of the locking cover seal or fastening for the purpose of venting the interior of the container. As a result of the gripping part 6 provided in a particular corner region, the bead interruption 18 or the venting point has a clearly defined association, so that when the packaging container 1 is stored in tilted manner, it can be arranged at the top with vertically positioned lid plane, in order to prevent the escape of packaged material at said bead interruption 18. Such an arrangement of the packaging container 1 is advantageous, so that it is possible to position the lid serving as a decoration and lettering carrier in a readily visible manner.

What is claimed is:

1. A packaging container with a container body and a lid connected to the opening rim by locking fastening means, whereby on one part of the lid rim is shaped an outwardly projecting gripping part, wherein the lid rim is laterally embraced by a rim portion of the container body and wherein the gripping part of the lid is non-detachably fixed to a rim extension of the container body connected to the latter by means of a predetermined breaking point.

2. A packaging container according to claim 1, wherein the gripping part is non-detachably connected to the rim extension by a pin pressed into a hole.

3. A packaging container according to claim 2, wherein the pin is a hollow pin with a bead shaped onto the underside of the gripping part.

4. A packaging container according to claim 1, wherein the locking fastening means comprise all-round engagement beads, which are provided on the lid and the inner opening rim of the container body.

5. A packaging container according to claim 4, wherein at least one bead interruption forming a container vent is provided on at least one of the engagement beads.

6. A packaging container according to claim 1, wherein the lid is made from a harder plastic material than the container body.

7. A packaging container according to claim 6, wherein the lid is made from polystyrene and the container body from polypropylene.

8. A packaging container according to claim 4, wherein the all-round rim portion projects over the lid rim.

9. A packaging container according to claim 1, wherein the lid and the container body are constructed so as to be inter-stackable.

10. A packaging container according to claim 1, wherein the rim portion runs over the entire container circumference, so that it also embraces the gripping part.

* * * * *